US007193572B2

(12) United States Patent
Magg et al.

(10) Patent No.: US 7,193,572 B2
(45) Date of Patent: Mar. 20, 2007

(54) ROOF ANTENNA FOR MOTOR VEHICLES

(75) Inventors: Christian Magg, Garching (DE); Peter Karl Prassmayer, Grosskarolinenfeld (DE); Frank Mierke, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/499,363

(22) PCT Filed: May 8, 2003

(86) PCT No.: PCT/EP03/04843

§ 371 (c)(1),
(2), (4) Date: Nov. 19, 2004

(87) PCT Pub. No.: WO03/098735

PCT Pub. Date: Nov. 27, 2003

(65) Prior Publication Data

US 2005/0062658 A1 Mar. 24, 2005

(30) Foreign Application Priority Data

May 16, 2002 (DE) ..... 102 21 877

(51) Int. Cl.
*H01Q 1/32* (2006.01)

(52) U.S. Cl. ..... 343/713; 343/711

(58) Field of Classification Search ..... 343/713, 343/711, 712, 715, 717, 700 MS
See application file for complete search history.

(56) References Cited

U.S. PATENT DOCUMENTS 3,680,127 A * 7/1972 Richard ..... 343/708
3,906,507 A * 9/1975 Allen, Jr. ..... 343/705
4,395,713 A * 7/1983 Nelson et al. ..... 343/713
5,181,044 A 1/1993 Matsuo et al.
5,471,222 A * 11/1995 Du ..... 343/713
5,831,577 A * 11/1998 Nichols et al. ..... 342/357.03
5,999,132 A 12/1999 Kitchener et al.
7,091,912 B2 * 8/2006 Iacovella et al. ..... 343/713
2004/0036659 A1 * 2/2004 Langley et al. ..... 343/713

FOREIGN PATENT DOCUMENTS

DE 38 26 777 A1 2/1990
DE 38 28 652 3/1990
DE 38 28 652 A1 3/1990

(Continued)

*Primary Examiner*—Hoanganh Le
(74) *Attorney, Agent, or Firm*—Nixon & Vanderhye P.C.

(57) ABSTRACT

The invention concerns a space craft, such as a telecommunication geostationary satellite, comprising a body, at lease one main telecommunication antenna having a specific orientation relative to the body, at least an omnidirectional antenna having a field of view opposite to that of the main antennae and at least a radiator extensible by tilting about an axis linked to the craft body between a slowing position wherein it is pressed against the body and an extended position. Said axis is positioned substantially in the plane of one surface of the body parallel to the orientation of the omnidirectional antenna and to the surfaces or the surface bearing the main antenna. The radiator tilts at an angle close to 180 o from a position wherein it is pressed against one surface bearing a solar panel to a position wherein it extends substantially in the plane of the surface which bears it when it is slowed.

14 Claims, 3 Drawing Sheets

FOREIGN PATENT DOCUMENTS

| | | | |
|---|---|---|---|
| DE | 40 05 030 | C2 | 8/1991 |
| DE | 40 05 029 | C2 | 9/1991 |
| DE | 40 07 824 | | 9/1991 |
| DE | 40 07 824 | A1 | 9/1991 |
| DE | 40 08 505 | | 9/1991 |
| DE | 40 08 505 | A1 | 9/1991 |
| DE | 40 37 712 | C2 | 6/1992 |
| DE | 92 11 012.6 | | 1/1993 |
| DE | 93 06 202 | | 9/1993 |
| DE | 43 39 260 | | 11/1993 |
| DE | 42 27 208 | A1 | 2/1994 |
| DE | 42 44 611 | | 7/1994 |
| DE | 43 13 396 | | 10/1994 |
| DE | 44 40 293 | C1 | 11/1994 |
| DE | 43 18 869 | | 12/1994 |
| DE | 43 18 869 | A1 | 12/1994 |
| DE | 94 14 817.1 | | 12/1994 |
| DE | 43 24 480 | C2 | 1/1995 |
| DE | 43 39 162 | | 5/1995 |
| DE | 295 00 961 | | 7/1995 |
| DE | 44 03 643 | A1 | 8/1995 |
| DE | 295 13 911 | | 12/1995 |
| DE | 295 13 911 | U1 | 12/1995 |
| DE | 44 33 725 | C2 | 3/1996 |
| DE | 296 04 218 | U1 | 6/1996 |
| DE | 195 09 906 | | 9/1996 |
| DE | 296 16 944 | U1 | 12/1996 |
| DE | 297 08 536 | U1 | 9/1997 |
| DE | 196 36 477 | C2 | 3/1998 |
| DE | 196 40 110 | C2 | 4/1998 |
| DE | 197 40 254 | A1 | 4/1998 |
| DE | 197 42 084 | A1 | 4/1998 |
| DE | 197 10 811 | A1 | 9/1998 |
| DE | 298 14 054 | U1 | 11/1998 |
| DE | 197 22 372 | A1 | 12/1998 |
| DE | 197 30 173 | | 1/1999 |
| DE | 298 18 813 | U1 | 1/1999 |
| DE | 197 39 395 | | 3/1999 |
| DE | 298 18 813 | | 3/1999 |
| DE | 298 22 825 | U1 | 4/1999 |
| DE | 199 25 127 | C1 | 5/1999 |
| DE | 298 21 717 | U1 | 6/1999 |
| DE | 298 21 723 | U1 | 6/1999 |
| DE | 694 19 080 | | 10/1999 |
| DE | 197 29 854 | C2 | 2/2000 |
| DE | 198 56 056 | A1 | 6/2000 |
| DE | 198 58 299 | A1 | 6/2000 |
| DE | 200 03 422 | | 6/2000 |
| DE | 199 58 481 | | 8/2000 |
| DE | 200 07 243 | U1 | 8/2000 |
| DE | 200 09 402 | | 10/2000 |
| DE | 19918894 | C | 10/2000 |
| DE | 200 09 412 | U1 | 11/2000 |
| DE | 200 12 981 | U1 | 11/2000 |
| DE | 199 22 699 | A1 | 12/2000 |
| DE | 199 41 476 | A1 | 3/2001 |
| DE | 199 58 605 | | 6/2001 |
| DE | 100 25 931 | | 8/2001 |
| DE | 100 09 978 | C2 | 9/2001 |
| DE | 20111229 | U | 10/2001 |
| DE | 100 36 591 | A1 | 12/2001 |
| DE | 100 35 820 | | 1/2002 |
| DE | 100 84 156 | T1 | 2/2002 |
| DE | 100 39 772 | A1 | 3/2002 |
| DE | 201 17 628 | U1 | 3/2002 |
| DE | 100 60 603 | A1 | 6/2002 |
| DE | 101 00 812 | A1 | 7/2002 |
| DE | 100 85 061 | T1 | 9/2002 |
| DE | 101 63 793 | A1 | 9/2002 |
| DE | 101 13 285 | A1 | 10/2002 |
| DE | 202 04 863 | U1 | 10/2002 |
| DE | 202 10 312 | U1 | 10/2002 |
| DE | 101 33 295.5 | | 1/2003 |
| DE | 101 33 295 | A1 | 1/2003 |
| EP | 0 590 955 | B1 | 9/1993 |
| EP | 0 662 255 | | 6/1994 |
| EP | 0 679 318 | B1 | 11/1994 |
| EP | 0637093 | A | 2/1995 |
| EP | 0 698 304 | | 3/1995 |
| EP | 747 991 | A2 | 12/1996 |
| EP | 747 993 | A2 | 12/1996 |
| EP | 0 594 809 | B1 | 7/1997 |
| EP | 806 060 | B1 | 11/1997 |
| EP | 0 817 306 | A2 | 1/1998 |
| EP | 0 837 521 | | 4/1998 |
| EP | 0862239 | A | 9/1998 |
| EP | 881 701 | B1 | 12/1998 |
| EP | 891 002 | B1 | 1/1999 |
| EP | 892 456 | A1 | 1/1999 |
| EP | 0989629 | A | 3/2000 |
| EP | 1 012 992 | B1 | 6/2000 |
| EP | 1 014 476 | A1 | 6/2000 |
| EP | 1 058 338 | A2 | 12/2000 |
| EP | 1 087 464 | A2 | 3/2001 |
| EP | 1 152 479 | A1 | 11/2001 |
| EP | 1 187 253 | A1 | 3/2002 |
| EP | 1 189 305 | A2 | 3/2002 |
| EP | 1 225 653 | A2 | 7/2002 |
| EP | 1 239 543 | A1 | 9/2002 |
| EP | 1 241 731 | A2 | 9/2002 |
| WO | WO 96/09941 | | 4/1996 |
| WO | WO 96/35241 | A1 | 11/1996 |
| WO | WO 97/19487 | A2 | 5/1997 |
| WO | WO 98/11624 | A1 | 3/1998 |
| WO | WO 98/44585 | A1 | 10/1998 |
| WO | WO 99/13591 | A1 | 3/1999 |
| WO | WO 99/35709 | A1 | 7/1999 |
| WO | WO 00/51199 | A2 | 8/2000 |
| WO | WO 00/70711 | A1 | 11/2000 |
| WO | WO 00/79642 | A1 | 12/2000 |
| WO | WO 01/08253 | A1 | 2/2001 |
| WO | 01/39321 | A | 5/2001 |
| WO | WO 01/43226 | A1 | 6/2001 |
| WO | WO 01/65634 | A1 | 9/2001 |
| WO | WO 01/71847 | A1 | 9/2001 |
| WO | WO 01/80366 | | 10/2001 |
| WO | WO 02/15335 | A1 | 2/2002 |
| WO | WO 02/21637 | A1 | 3/2002 |
| WO | WO 02/35646 | A1 | 5/2002 |
| WO | WO 02/47201 | A1 | 6/2002 |
| WO | WO 02/69444 | A1 | 6/2002 |
| WO | WO 02/056413 | A1 | 7/2002 |
| WO | WO 02/065579 | | 8/2002 |
| WO | WO 02/65579 | A1 | 8/2002 |
| WO | WO 02/80307 | A1 | 10/2002 |
| WO | WO 02/84800 | A2 | 10/2002 |
| WO | WO 02/47198 | A2 | 9/2003 |
| WO | 01/26182 | A | 4/2004 |

* cited by examiner

ROOF ANTENNA FOR MOTOR VEHICLES

This application is the U.S. national phase of international application PCT/EP03/04843 filed 8 May 2003, which designated the U.S. PCT/EP03/04843 claims priority to DE Application No. 102 21 877.3 filed 16 May 2002. The entire contents of these applications are incorporated herein by reference.

FIELD

The technology herein relates to antenna arrangements.

BACKGROUND AND SUMMARY

An antenna arrangement has been disclosed, for example, in DE 201 11 229 U 1. This prior publication describes an antenna arrangement for motor vehicles which has a chassis. A printed circuit board is arranged above the chassis in order to accommodate circuit components. One or more vertically projecting antenna elements, which is or are at least partially flat, is or are provided vertically with respect to the printed circuit board. The printed circuit board is aligned essentially horizontally to receive different services or for different frequencies in the mobile radio band.

The entire antenna arrangement is covered by a shroud which may have a shape similar to a fin. Antennas such as these are normally fitted to the motor vehicle bodywork plate, for example at the junction between the motor vehicle roof and the rear windshield.

A multiple frequency antenna arrangement in particular for motor vehicles having a corresponding shroud has been disclosed in EP 0 862 239 A1. By way of example, two printed circuit boards, which are aligned vertically and are offset laterally transversely with respect to the vertical plane are provided in the housing, which is in the form of a shroud, for accommodation of the electronic components. A connecting adapter is provided at the upper end of the housing, that is to say at the uppermost point of the shroud, in order to make it possible to attach an antenna in the form of a whip antenna there.

An antenna which can preferably be used for cars has likewise been disclosed in DE 694 19 080 C2. This antenna also has a housing in the form of a shroud, at whose uppermost projection point a connecting point is provided for a whip antenna. One or more printed circuit board elements, which are aligned vertically or horizontally, can be arranged within the antenna housing. In one arrangement, these printed circuit board elements are likewise arranged parallel to one another and are arranged alongside one another transversely with respect to the plane of the printed circuit board, to be precise aligned transversely with respect to the vehicle longitudinal axis. However, they may also likewise be arranged with a lateral offset parallel to one another, to be precise aligned longitudinally with respect to the vehicle axis.

Furthermore, antenna arrangements are also known in which the printed circuit board is provided with electronic circuitry components, filter circuits etc. formed on a more or less horizontal chassis. The antenna elements are once again positioned vertically at right angles to this, in the vertical direction. These antenna elements may, for example, not only be composed of metallically conductive self-supporting antenna element devices but, for example, may likewise once again be formed from a printed circuit board element, that is to say in general from a dielectric material, on which metalized surfaces are provided in order to form the antenna elements.

If the aim is now to receive in only one frequency band range, then one antenna element is sufficient. If the aim is to provide two or more services or one service more than once, or if the aim is, for example, to communicate in various frequency bands in the mobile radio range, then, of course, two or more antenna elements are provided, which are offset with respect to one another or are flat.

The exemplary illustrative non-limiting technology herein provides a further improved antenna arrangement which, in principle, has good antenna characteristics with reduced production and material costs overall.

It has now surprisingly been found that there is no need for a horizontal, separate printed circuit board with the matching circuit required for the antenna. Specifically, according to the exemplary illustrative non-limiting technology herein, one or more printed circuit boards are used, which are preferably aligned alongside one another vertically on a common plane and are provided adjacent to the at least one antenna element. The appropriate components for a radio-frequency circuit, which may possibly be provided, are, for example, accommodated on this vertically aligned printed circuit board.

According to the exemplary illustrative non-limiting technology herein, the use of a vertically aligned printed circuit board once again allows the overall design of a corresponding antenna arrangement to be simplified considerably. One surprising feature of this illustrative non-limiting implementation is that the vertically aligned printed circuit board, which rests on the antenna element at the side, does not influence the antenna polar diagram disadvantageously in the manner which would intrinsically be expected.

One exemplary illustrative non-limiting implementation provides at least one antenna element arrangement that is not provided above the printed circuit boards but at the side, alongside this at least one printed circuit board. This prevents any disadvantageous influence on the polar diagram characteristic. This is also particularly surprising, and is not obvious, because an antenna such as this with as broad a bandwidth as possible for the mobile radio field is designed for wavelengths in the range from around 15 cm to 30 cm, so that the size of the vertically arranged printed circuit board is in the range that is relevant for these wavelengths.

Furthermore, in one exemplary illustrative non-limiting implementation, it is possible to provide only a single printed circuit board on which not only the radio-frequency circuit which may possibly be provided is accommodated but on which, for example, flat conductive sections can then also be formed on other section areas, forming the relevant antenna element, in this case, widely differing geometric shapes can be used to form the antenna element. For example, whip antenna implementations may have a vertically running, flat antenna section, which merges at the top into, for example, an antenna section at the rear.

If, by way of example, a further antenna element is intended to be provided for a second frequency band for the mobile radio area, or in order to provide further services, then this likewise can preferably be provided as a flat antenna element in an area of the printed circuit board that is offset with respect to the first antenna element. However, in precisely the same way, it is also possible to use a further printed circuit board element, which is located on the same plane as the first printed circuit board element or, for example, is offset laterally parallel to it, in order to accommodate the at least one further antenna element here.

Thus, overall, the antenna elements and the radio-frequency circuit which may possibly be provided can be accommodated in a preferred manner on a single, common printed circuit board arrangement.

In one exemplary illustrative non-limiting implementation, a cap, which is used for mechanical retention, is required only for installation on the motor vehicle and for mechanical anchoring of the printed circuit board and of the antenna elements located on it.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
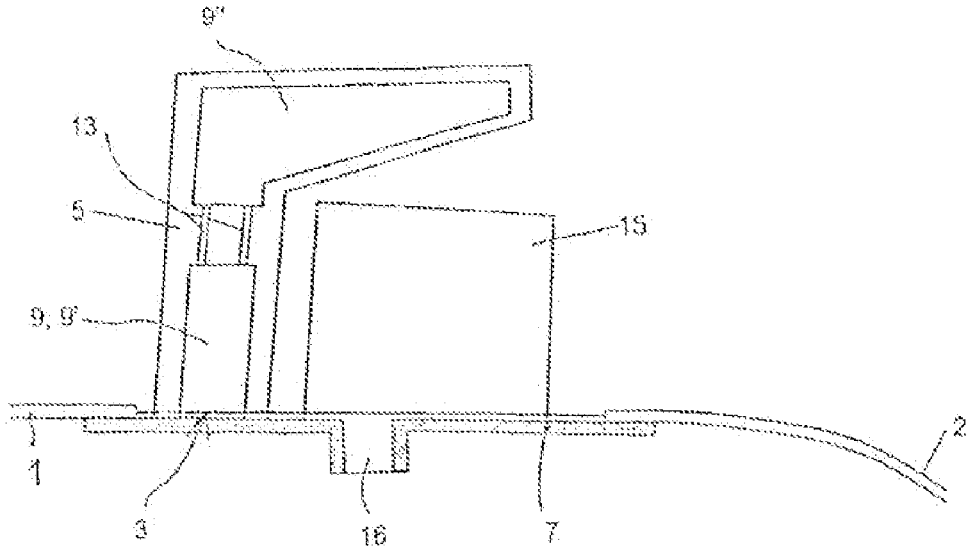
FIG. 1 is a schematic side illustration of an antenna arrangement with a printed circuit board side mounted on a common plane in the vertical direction.

FIG. 1 is a schematic side illustration of an exemplary illustrative non-limiting implementation of a motor vehicle bodywork plate 1, for example at the rear end of the roof, at the junction to a rear window 2, illustrated schematically from the side.

With the opening 3 in the bodywork plate 1 having an appropriately large size, a cap plate or base plate 7 with a printed circuit board 5 that is aligned vertically with respect to it and has electrically conductive surface sections 9' on it is mounted from underneath on the bodywork plate 1, thus forming an antenna element arrangement 9. The flat elements 9' are in this case normally aligned in the vehicle longitudinal direction. The entire antenna element arrangement 9 is normally fitted on the line of symmetry of the motor vehicle.

In the illustrated exemplary illustrative non-limiting implementation, the antenna element arrangement 9 (starting from the lower cap plate or base plate 7 which is arranged essentially horizontally or at a slight angle to the horizontal on the motor vehicle bodywork plate 1) comprises a vertically running first flat section 9', to which a whip antenna section 9", which extends to the rear, can then be connected. In the illustrated exemplary illustrative non-limiting arrangement, both antenna sections 9' and 9" are electrically connected to one another via a combination comprising an inductance and capacitance 13.

A printed circuit board 15 is provided on the same plane, directly adjacent to the antenna element arrangement 9, that is to say in the illustrated exemplary illustrative non-limiting arrangement in the same vertical plane on the first antenna element section 9' which extends vertically, on which the radio-frequency circuit of the antenna arrangement, which may possibly be provided, is accommodated. In this exemplary illustrative non-limiting implementation, all of the necessary electrical components and assemblies, filter modules, etc. are seated on this printed circuit board section 15.

The corresponding connecting cables can then be introduced into the motor vehicle interior through an opening 16, which may possibly be provided in the cap plate or base plate 7.

Figure 2:
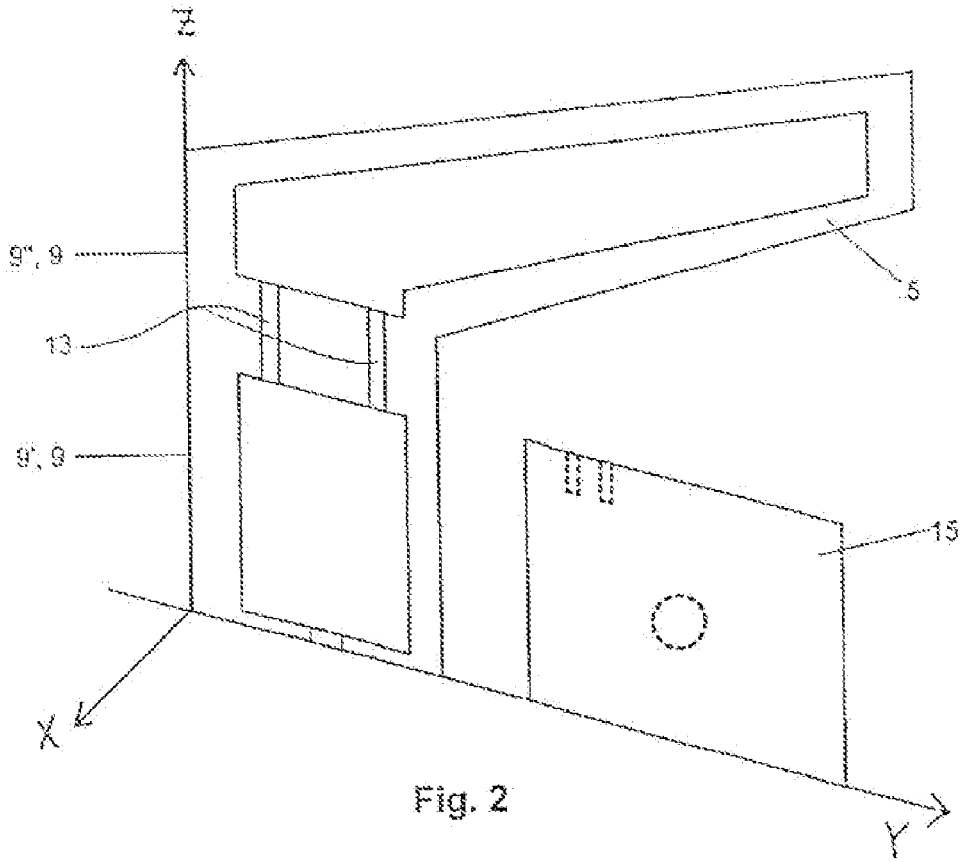
FIG. 2 is a schematic perspective illustration of the exemplary illustrative non-limiting arrangement shown in FIG. 1.

FIG. 2 shows a corresponding illustrative exemplary non-limiting arrangement once again, illustrated schematically in perspective form, showing the three spatial coordinates X, Y and Z, in order to illustrate the perspective.

Figure 3:
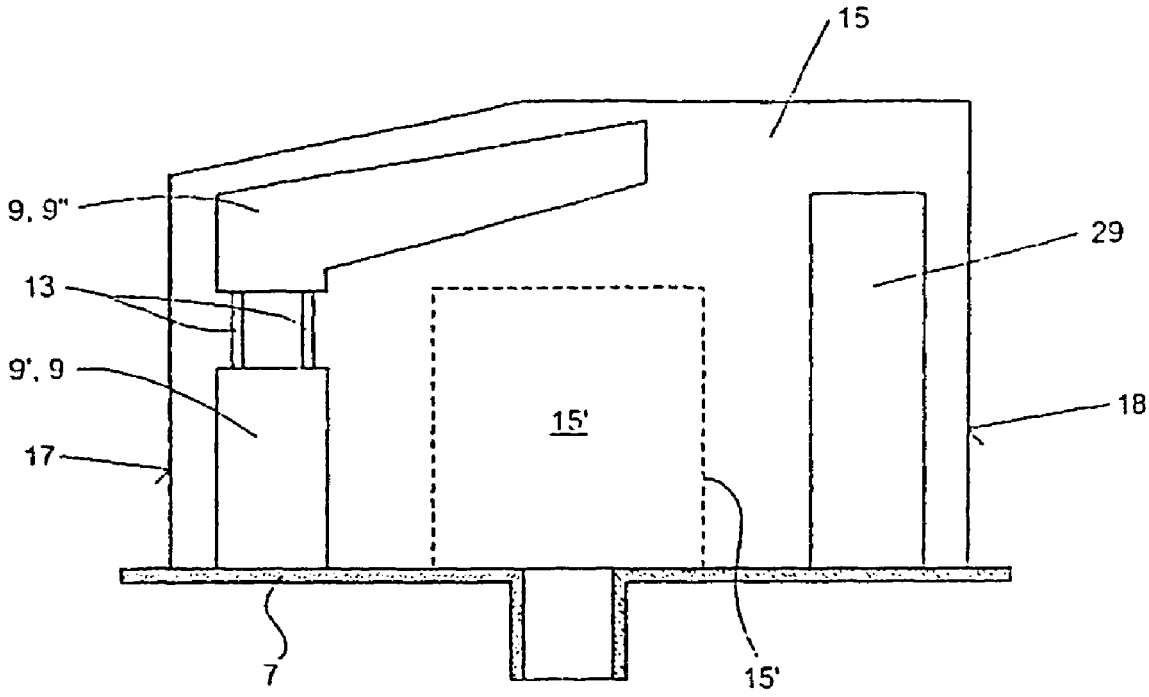
FIG. 3 is a side illustration of a further modified exemplary illustrative non-limiting arrangement of a printed circuit board with an antenna element located thereon.

In the exemplary illustrative non-limiting arrangement shown in FIG. 3, the entire arrangement is provided on a common printed circuit board 15. In other words, the flat antenna element 9 with the two flat antenna element sections 9', 9" and the combination comprising the inductance and capacitance 13, is provided on this common printed circuit board 15, running in the motor vehicle direction. In the exemplary illustrative non-limiting arrangement illustrated in the drawing, this motor vehicle direction is on the front side 17 on the left. In one exemplary illustrative non-limiting implementation, the flat antenna element 9 is formed for example by means of appropriate metalization formed on the printed circuit board 15.

The radio-frequency circuit which may possibly be provided is then in turn accommodated, with the appropriate components and parts, in a space 15' which, for example, is bounded by a rectangular shape.

In the exemplary illustrative non-limiting arrangement shown in FIG. 3, a second antenna element arrangement 29, for example in the form of a metalized surface, is also provided on the common, vertically aligned printed circuit board 15, in the rear area 18 of the printed circuit board 15. The radio-frequency circuit which may possibly be provided for the two antenna element arrangements 9, 29 in the printed circuit board section 15' is accommodated on the common printed circuit board 15 between the two antenna element arrangements 9, 29.

Alternatively, the antenna element arrangements 9 and 29 may be formed separately from the printed circuit board 15. However, in this exemplary illustrative non-limiting arrangement as well, the printed circuit board 15 will preferably be located aligned vertically immediately at the side between the two antenna element arrangements 9, 29.

As mentioned, the entire arrangement is held mechanically by means of the cap or the so-called base plate 7.

If required, certain sections on the printed circuit board 15 may also be omitted or knocked out, if, for example, it is intended to accommodate an antenna element there which, in contrast to the illustrated exemplary illustrative non-limiting arrangement, is not aligned vertically, for example in the case of a GPS antenna. The printed circuit board 15 may thus have apertures or knocked-out sections in order to accommodate additional antenna elements in that area.

Figure 1A:
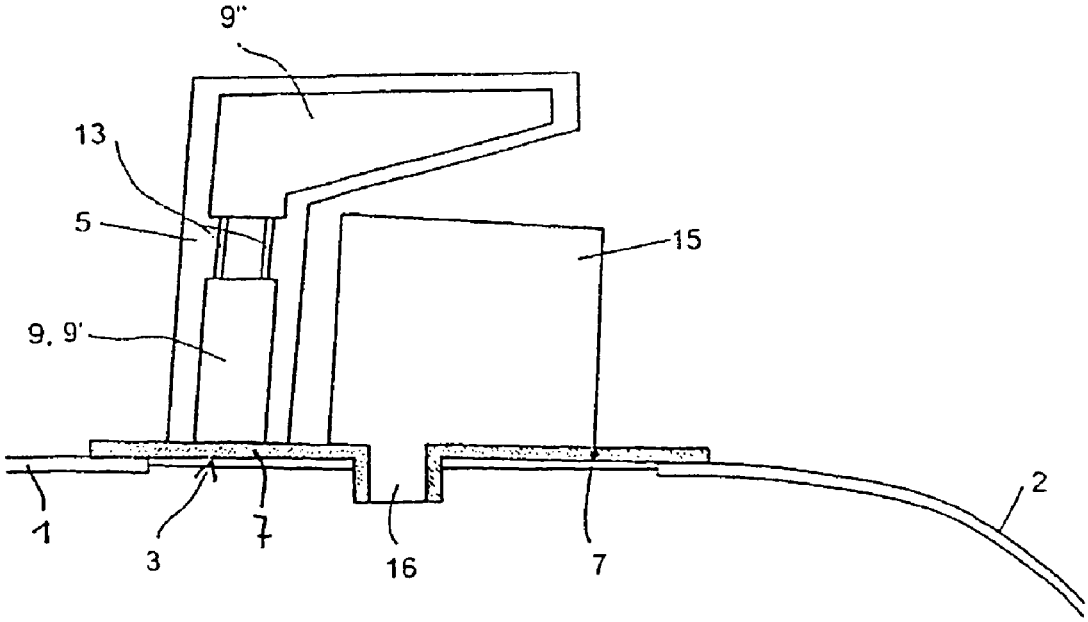
FIG. 1*a* is an exemplary illustrative non-limiting arrangement corresponding to FIG. 1, provided with roof mounting.

As a supplement to the illustrated and described FIG. 1, a further FIG. 1*a* is also illustrated. The exemplary illustrative non-limiting arrangement shown in FIG. 1*a* relates to roof mounting. In other words, the cap plate or base plate 7 is thus generally flush mounted on the bodywork roof from above on the bodywork plate 1, so that the cap plate or base plate 7 covers the opening 3.

Figure 1B:
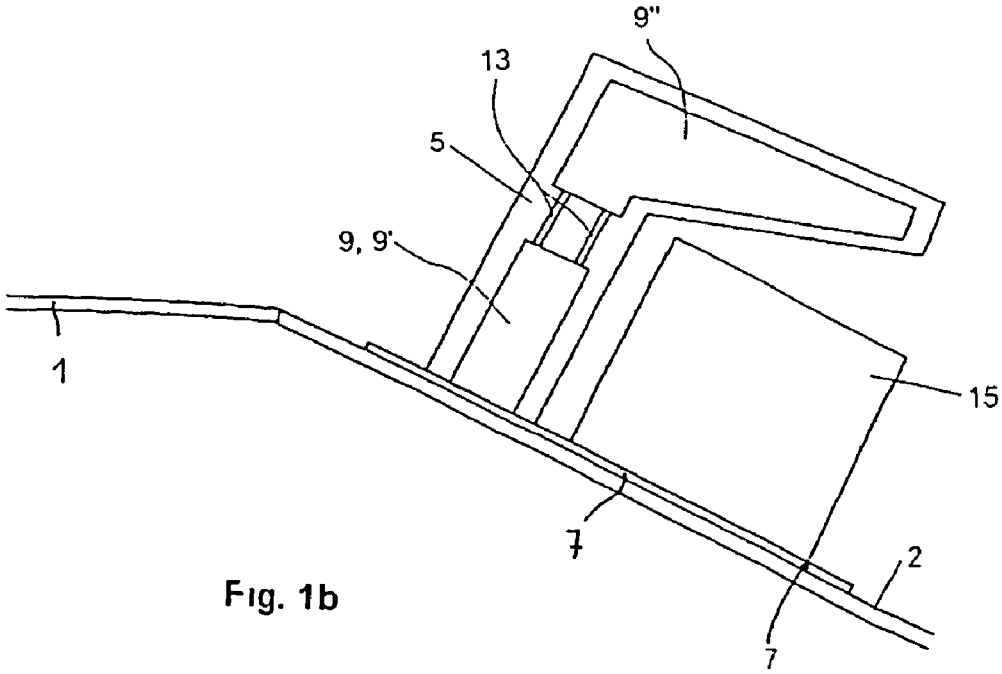
FIG. 1*b* shows an exemplary illustrative non-limiting arrangement in which the antenna arrangement is mounted with a modified base at the upper edge of a rear windshield.

The exemplary illustrative non-limiting implementation shown in FIG. 1*b* uses a different type of base plate or cap plate 7, by means of which the antenna arrangement can also be mounted on a glass pane, for example on a rear windshield of a motor vehicle, preferably at the upper edge in the vicinity of the junction with the bodywork roof. An appropriate protective shroud, which is not illustrated in any more detail, is also fitted in all cases, and covers and protects the entire illustrated antenna arrangement.

While the technology herein has been described in connection with exemplary illustrative non-limiting arrangements, the invention is not to be limited by the disclosure. The invention is intended to be defined by the claims and to cover all corresponding and equivalent arrangements whether or not specifically disclosed herein.

The invention claimed is:

1. An antenna arrangement for a motor vehicle bodywork plate, comprising:

a mounting cap, at least one antenna element arrangement which extends on a first vertically running plane, a first printed circuit board, arranged such that it runs vertically, said printed circuit board having thereon at least one radio-frequency circuit comprising plural electrical assemblies and/or components, a protective shroud, a further, vertically aligned printed circuit board, the at least one antenna element arrangement comprising a conductive surface on the further vertically aligned printed circuit board, the at least one antenna element arrangement extending from the mounting cap in the vertical direction, the first printed circuit board and the at least one antenna element arrangement lying on a common plane, and at least a section of the first printed circuit board which has thereon said plural electrical assemblies and/or components being laterally aligned when viewed transversely with respect to the antenna element arrangement.

2. The antenna arrangement as claimed in claim 1, wherein the at least one antenna element arrangement comprises antenna element sections which are aligned at an angle to one another and lie on a common plane.

3. The antenna arrangement as claimed in claim 2, wherein said at least one antenna element arrangement comprises first and second antenna element sections, the first antenna element section being aligned in a direction behind the second antenna element section, the second antenna element section being located at least above a portion of the first printed circuit board on which plural electrical assemblies and/or components are provided.

4. The antenna arrangement as claimed in claim 1, further comprising at least a second antenna element arrangement offset with respect to the first-mentioned antenna element arrangement and which lies on the same vertical plane as the first-mentioned antenna element arrangement.

5. The antenna arrangement as claimed in claim 1, wherein the at least one antenna element arrangement comprises plural antenna element arrangements, and the first printed circuit board has an area which accommodates electronic assemblies, said area being provided between said plural antenna element arrangements.

6. The antenna arrangement as claimed in claim 1, wherein the at least one antenna element arrangement and the printed circuit board section which has thereon said electrical assemblies and/or components comprise separate assemblies, which are arranged offset with respect to one another on a common vertical plane.

7. The antenna arrangement as claimed in claim 1, wherein the first printed circuit board has formed thereon both the at least one antenna element arrangement and at least one section having electrical assemblies and/or components thereon.

8. The antenna arrangement as claimed in claim 1, wherein at least one of the first and further printed circuit boards has apertures to accommodate additional antenna elements.

9. The antenna arrangement as claimed in claim 1, further including a bodywork plate, and wherein the mounting cap is, in use, disposed on a roof mounting, by an edge section, at least indirectly on the bodywork plate.

10. The antenna arrangement as claimed in claim 2, further including a bodywork plate, and wherein the antenna element arrangement is connected in the form of a flush mounting, by means of an edge section thereon, at least indirectly to the bodywork plate.

11. The antenna arrangement as claimed in claim 1, wherein said motor vehicle includes a rear windshield having a glass pane, and wherein the mounting cap is mounted on the glass pane, in the area of the upper edge of the rear windshield of said motor vehicle.

12. A multi-band mobile antenna comprising:

a printed circuit board that, in use, is vertically aligned, said printed circuit board having radio frequency components including a matching circuit thereon;

plural antenna elements each comprising a corresponding conductive radiator surface, wherein the printed circuit board and conductive radiator surfaces are coplanar and arranged laterally alongside one another when viewed transversely with respect to the antenna elements, the plural antenna elements providing multi-band operation;

a mounting cap supporting said plural antenna elements in the vertical direction; and a protective shroud protecting said plural antenna elements and said printed circuit board.

13. A multi-band mobile antenna comprising:

a first, vertically aligned printed circuit board having radio frequency components including a matching circuit thereon;

a second, vertically aligned printed circuit board that is physically separate from and coplanar to said first printed circuit board, said second printed circuit board having formed thereon plural antenna elements comprising corresponding conductive radiator surfaces, wherein the first printed circuit board and conductive radiator surfaces are coplanar and arranged laterally alongside one another when viewed transversely with respect to the plural antenna elements, the plural antenna elements providing multi-band operation;

a mounting cap supporting said antenna elements in the vertical direction;

a protective shroud protecting said antenna elements and said first and second printed circuit boards; and a feed arrangement that feeds said antenna from beneath at least one of said first and second printed circuit boards.

14. The antenna of claim 13 wherein at least one of said conductive radiator surfaces comprises a whip antenna suspended over at least a portion of said first printed circuit board.

* * * * *